United States Patent [19]

Kawamura et al.

[11] 4,331,105

[45] May 25, 1982

[54] FORCED-FLOW ONCE-THROUGH BOILER FOR VARIABLE SUPERCRITICAL PRESSURE OPERATION

[75] Inventors: Tomozuchi Kawamura; Hisao Haneda; Mamoru Araoka, all of Tokyo, Japan

[73] Assignee: Mitsubishi Jukogyo Kabushiki Kaisha, Japan

[21] Appl. No.: 184,771

[22] Filed: Sep. 8, 1980

[30] Foreign Application Priority Data

Nov. 21, 1979 [JP] Japan ..... 54-151179

[51] Int. Cl.[3] ..... F22B 29/12

[52] U.S. Cl. ..... 122/406 S; 122/DIG. 4; 122/6 A

[58] Field of Search ..... 122/406 S, 488, 451 S, 122/6 A, DIG. 4

[56] References Cited

U.S. PATENT DOCUMENTS

| | | | |
|---|---|---|---|
| 2,908,255 | 10/1959 | Michel | 122/DIG. 4 |
| 3,212,477 | 10/1965 | Gerber et al. | 122/406 S |
| 3,259,111 | 7/1966 | Koch | 122/406 S |
| 3,927,646 | 12/1975 | Dungey et al. | 122/6 A |
| 4,000,720 | 1/1977 | Lieb et al. | 122/6 A |
| 4,072,182 | 2/1978 | Cheng | 122/DIG. 4 |
| 4,175,519 | 11/1979 | Pratt et al. | 122/6 A |
| 4,191,133 | 3/1980 | Stevens | 122/6 A |
| 4,198,930 | 4/1980 | Pratt et al. | 122/6 A |
| 4,205,633 | 6/1980 | Wittchon | 122/406 S |
| 4,245,588 | 1/1981 | Gill et al. | 122/6 A |
| 4,261,301 | 4/1981 | Losel et al. | 122/406 S |

*Primary Examiner*—Henry C. Yuen
*Attorney, Agent, or Firm*—McGlew and Tuttle

[57] ABSTRACT

A forced-flow once-through boiler for variable supercritical pressure operation comprises burners, water-wall tubes constituting the surrounding walls of a furnace and which are themselves made up of banks of vertical generating tubes for simultaneous upward flow, and a convection-heating type evaporator mounted between the outlets of the water-wall tubes and a water separator.

1 Claim, 11 Drawing Figures

FORCED-FLOW ONCE-THROUGH BOILER FOR VARIABLE SUPERCRITICAL PRESSURE OPERATION

FIELD AND BACKGROUND OF THE INVENTION

Conventional once-through boilers for variable pressure operation, as illustrated in FIG. 1, use furnace wall tubes consisting of spiral generating tubes which are inclined at gentle angles in the lower part of the furnace including the burner sections where the heat absorption is the highest in the furnace. In such a spirally wound boiler, all the generating tubes extend uniformly through the furnace regions where the heat absorption is high and the regions where the absorption is low. Consequently, there is little variation in absorption of heat by those generating tubes. With a uniform length, the tubes maintain a constant flow rate throughout, and the fluid temperature at the exit of the furnace shows a quite uniform distribution over the entire surrounding walls of the furnace.

In a boiler of the simultaneous upward flow type whose water-cooled walls consist of vertical tubes, unlike the counterparts of the spirally-wound monotube boilers, the generating tubes are so arranged that the fluid in some of the tubes passes through only the furnace regions where the heat absorption is high and in the other tubes passes through only the regions of low heat absorption. Naturally, the generating tubes show irregularities in heat absorption. Especially in the boiler equipped with corner-firing burners, the heat absorption is high in the center and low at the corners of the furnace. In view of this, a modified design employs water-cooled walls each consisting of a bank of generating tubes welded in parallel to a panel form, and, in order to avoid the development of excess thermal stresses in the water-cooled walls, an orifice is formed at the inlet of each generating tube or at the inlet of each distributing tube for each group of several generating tubes, and the rate of fluid flow in each tube is regulated by means of the orifice. In this way, in the boiler fitted with the corner-firing burners, as indicated by a full line in FIG. 2, the fluid temperatures at the outlets of the generating tubes at the exit of the furnace are kept substantially uniform over the entire surrounding walls of the furnace. The chain-line curve in FIG. 2 represents the temperature distribution obtained in the same manner but with generating tubes free of orifices.

Thus, the corner-fired boiler for constant-pressure operation, capable of maintaining a constant pressure in the furnace regardless of variation in load, offers an outstanding advantage that, as can be seen from FIG. 3, the pattern of heat absorption does not change in the width direction of the furnace. The use of orifices permits the maintenance of substantially the same temperature at the outlets of water-cooled walls of the furnace despite changes in working load and operating conditions.

However, with a boiler of the type which gives dry steam at the outlets of the water-cooled walls over a broad range of pressure changes, from the supercritical pressure down to a low pressure of about 80 kg/cm$^2$G as in a pressure-enthalpy chart of FIG. 4, changes in load are accompanied by considerable changes in the ratio of the specific volume at the inlets of generating tubes of the furnace, $V_i$, to the specific volume at the outlets, $V_o$, as indicated in FIG. 5. Therefore, although the ratio in heat absorption rate of highly heat-absorptive central region of the furnace to the corner regions where less heat is absorbed does not change under all load conditions to be encountered, it is not always easy to maintain uniform fluid temperature distribution at the outlets of the water-cooled walls of the furnace throughout the entire load range by means of only one type of fixed orifices. Especially in the low-pressure region, even a relatively slight difference in heat absorption will put the highly heat absorptive generating tubes into the superheated steam region and the less absorptive generating tubes in the wet steam region. As a consequence, the temperature difference between the two is widened to a disadvantage in that the planer panel stresses that result from thermal stressing are too high to build a single water-wall tube panel.

As explained, with the vertical tube type boiler for variable pressure operation, which works with its furnace generating tube outlets in the dry steam region over the broad pressure range from the supercritical region under heavy load down to 80 kg/cm$^2$G under light load, it is no longer satisfactory to rely merely upon orifice means for the control of heat absorption.

For the solution of these problems, the permissible minimum pressure for the operation of the boiler must be limited; for example, it must be raised to a higher pressure level. However, this means a corresponding rise of the lower limit for the operating pressure under part load, which will lead to a greater rate of turbine heat consumption due to an increased power requirement for pumping feedwater to the boiler. The outcome is not desirable from the economy-saving standpoint.

SUMMARY OF THE INVENTION

The present invention has for its object to provide, in order to settle all of the foregoing problems of the conventional boilers, a forced-flow once-through boiler for variable supercritical pressure operation comprising burners, water-wall tubes constituting the surrounding walls of a furnace and which are themselves made up of banks of vertical generating tubes for simultaneous upward flow, and a convection-heating type evaporator mounted between the outlets of the water-wall tubes and a water separator.

With the boilers of conventional designs it has been necessary for the sake of boiler performance that, in the once-through operating region of the boiler, the steam at the inlet of each superheater should be superheated to some degree to provide superheated steam. For the boiler of the corner fired type having a vertical upward generating tube type furnace for variable supercritical pressure operation, it has not necessarily been easy, when the steam at the outlets of the water-cooled walls is dry, to adjust the difference in heat absorption between the generating tubes located in the center of the furnace and those at the corners of the furnace. According to this invention, therefore, a gas duct evaporator is installed between the water-cooled walls of the furnace and the water separator so as to provide superheated steam regions at the inlets of the superheaters while maintaining the water-cooled wall outlets in the wet steam region as illustrated FIG. 6.

BRIEF DESCRIPTION OF THE DRAWINGS

The above and other objects, features, and advantages of the invention will become more apparent from the following detailed description taken in conjunction with the accompanying drawings, in which.

DETAILED DESCRIPTION

Figure 7:
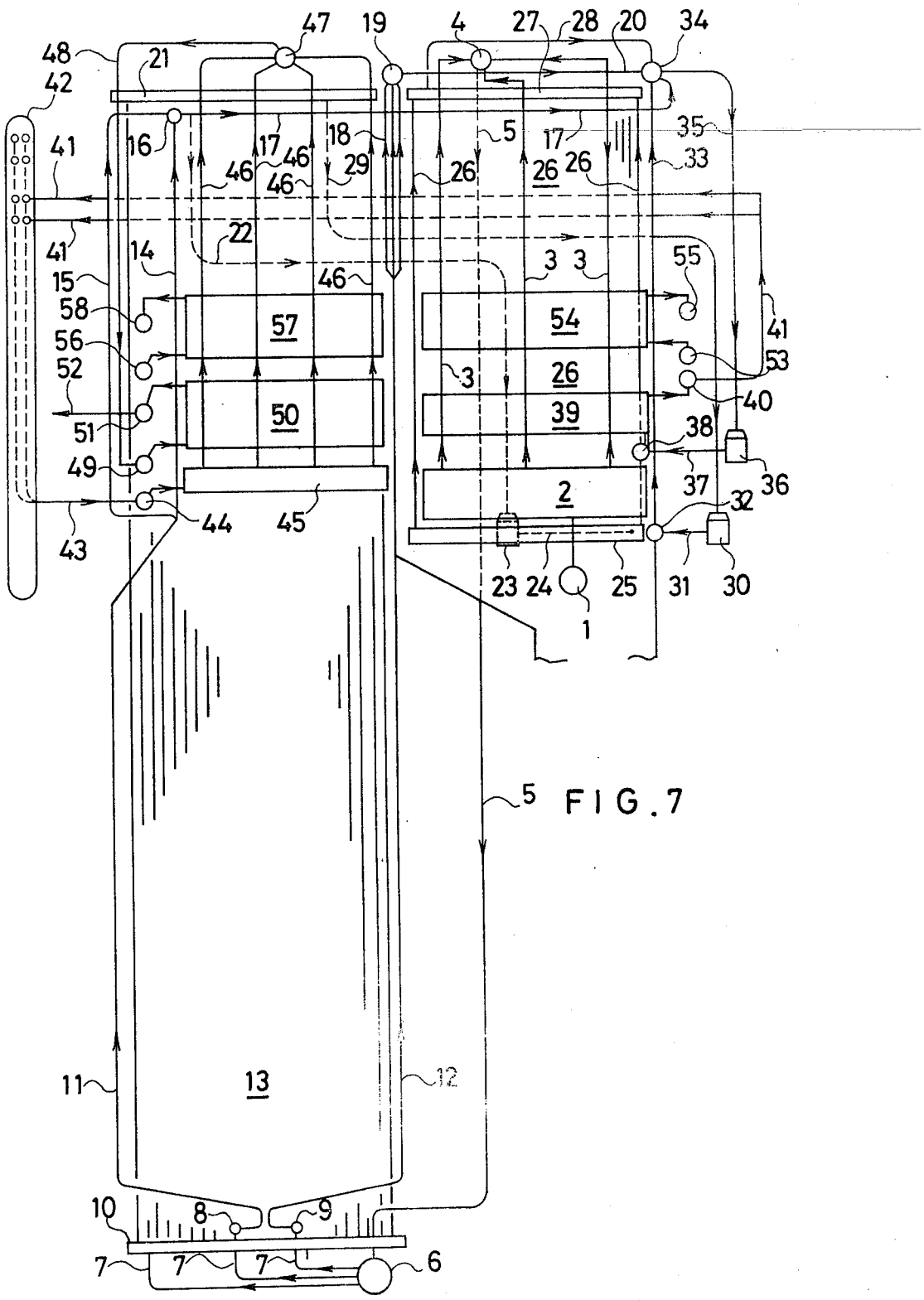
FIG. 7 is a schematic side view of a boiler embodying the invention.
Figure 8:
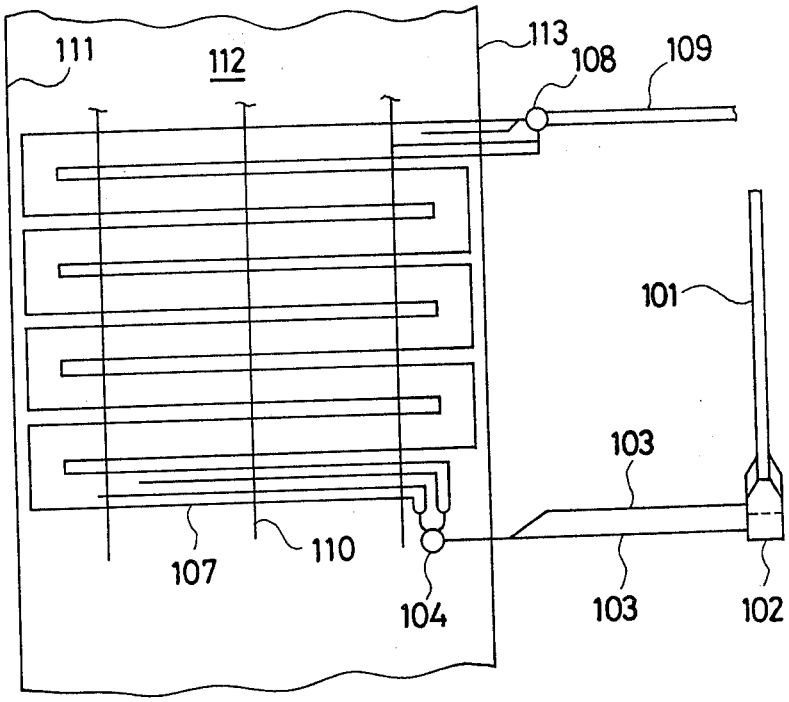
FIG. 8 is an enlarged view of the gas duct evaporator shown in FIG. 7.

Referring to FIG. 7, there is shown a corner-fired boiler according to the invention. Feedwater to the boiler first enters an economizer inlet header 1 and thence into an economizer 2. As shown, the water from the economizer 2 passes through economizer-hanger tubes 3, which also carry a gas duct evaporator 39 and a low-temperature reheater 54, toward an economizer outlet header 4. Past the header 4, the water falls through a downcomer 5 into a distributing ball 6, where it is divided into substreams and forced through distributing pipes 7 into distributing chambers formed as divided by partitions inside inlet headers 8, 9, 10 of the front, rear, and side walls of the furnace. The inlets of the distributing pipes at the distributing ball 6 are provided with orifices to meter the water supply to the respective distributing chambers. To the front, rear, and side wall inlet headers 8, 9, 10 are connected, respectively, banks of front wall tubes 11, rear wall tubes 12, and side wall tubes 13, whose inlets too are provided with orifices for flow rate regulation and further improvement of system stability. The front wall tubes 11 in a bank are bifurcated in the upper part of the furnace, forming a bank of front wall baffle tubes 14 which partitions the upper space into a gas passageway and a front wall header chamber, and a bank of front wall hanger tubes 15 which carries the weight of the furnace. The tubes in two branch banks are joined again at a front wall outlet header 16. A steam-water mixture leaving this header 16 goes through ceiling tubes 17 into a rear wall outlet header 34 of the rear gas duct.

Meanwhile, the water that entered the rear wall tubes 12 of the furnace moves upward into a rear wall outlet header 19 through rear wall screen tubes 18 which are spaced apart to permit the flow of combustion gases from the upper gas duct to the rear duct of the furnace. The water then passes through rear wall riser tubes 20 and, like the water distributed among the front wall tubes of the furnace, it finally enters the rear wall outlet header 34 of the rear gas duct. The water dividedly supplied to the side wall tubes 13 of the furnace is led to a side wall outlet header 21 and thence the side and rear walls of the rear gas duct, respectively, via side and rear wall inlet connecting tubes 22 and 29 of the rear gas duct. The side wall inlet connecting tubes 22 are connected to a side wall distributing manifold 23 of the rear gas duct, which in turn is connected to a side wall inlet header 25 of the rear gas duct with a number of distributing tubes 24. A steam-water mixture from the side wall inlet header 25 flows through rear-gas-duct side wall tubes 26 into an outlet header 27 on the same side wall. From the header 27 the mixture passes through side wall riser tubes 28 and eventually enters the rear wall outlet header 34 of the rear gas duct, like the fluids from the front wall tubes 11 and the rear wall tubes 12 of the furnace. Similarly, the steam-water mixture that entered the rear wall inlet connecting tubes 29 of the rear gas duct then reaches a rear wall distributing manifold 30 of the duct. Next, it proceeds through a number of rear wall distributing tubes 31 to a rear wall inlet header 32 of the rear gas duct and further through rear wall tubes 33 to a rear wall outlet header 34 of the rear gas duct. In this way the substreams of water once admitted to the front, rear, and side walls of the furnace are all put together in the rear wall outlet header 34 of the rear gas duct.

The steam-water mixture collected in the outlet header 34 of the rear wall is led through an evaporator inlet connecting tube 35 into an evaporator distributing manifold 36 of the gas duct. In the duct, the fluid mixture from the manifold 36 passes through a number of evaporator distributing tubes 37, evaporator inlet header 38, evaporator tubes 39, evaporator outlet header 40, and outlet connecting tubes (water-separator inlet connecting tubes) 41 into a water separator 42. The steam condition in the water separator 42 is such that, under load exeeding the minimum once-through load, the steam is in a superheated region. In this load condition, the steam that entered the water separator 42 is all superheated as it is led through superheater inlet connecting tubes 43, inlet header 44, primary superheater tubes 45, primary superheater hanger tubes 46, primary superheater outlet header 47, secondary superheater inlet connecting tubes 48, secondary superheater inlet header 49, secondary superheater tubes 50, and superheater outlet header 51. The superheated steam is then conducted through a main steam pipe 52 to a turbine not shown.

In FIG. 7 the numerals 53 through 58 indicate, respectively, a reheater inlet header, low-temperature reheater tubes, low-temperature outlet header, high-temperature reheater inlet header, high-temperature reheater tubes, and reheater outlet header.

Figure 1:
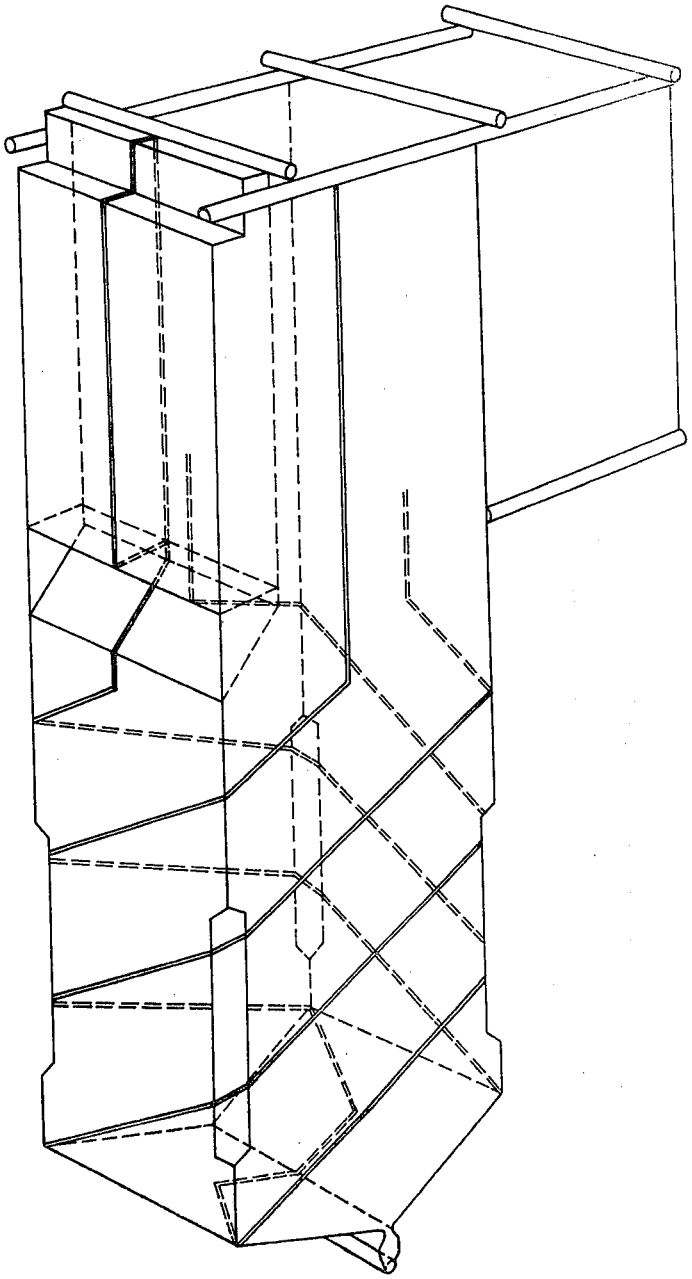
FIG. 1 is a perspective view of a conventional spirally wound boiler.
Figure 2:
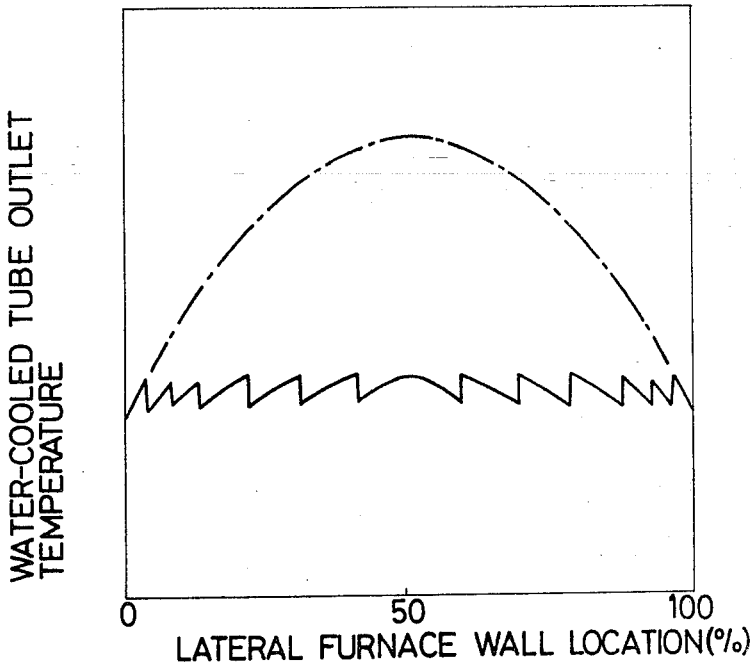
FIG. 2 is a graph typically representing the temperature distribution at the water-cooled wall outlets of an ordinary vertical upward flow type boiler equipped with corner-firing burners.
Figure 3:
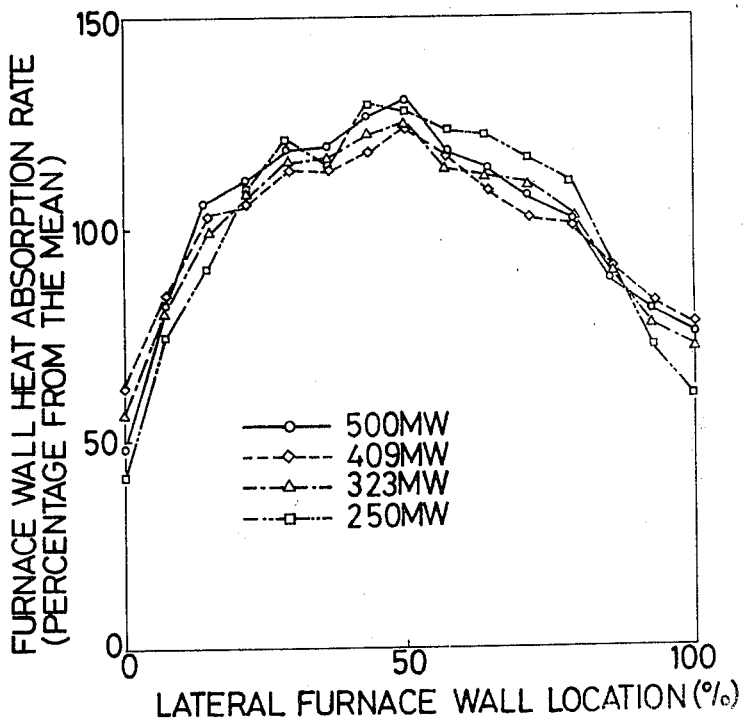
FIG. 3 is a graph showing the heat absorption patterns of the furnace walls of the same boiler.
Figure 4:
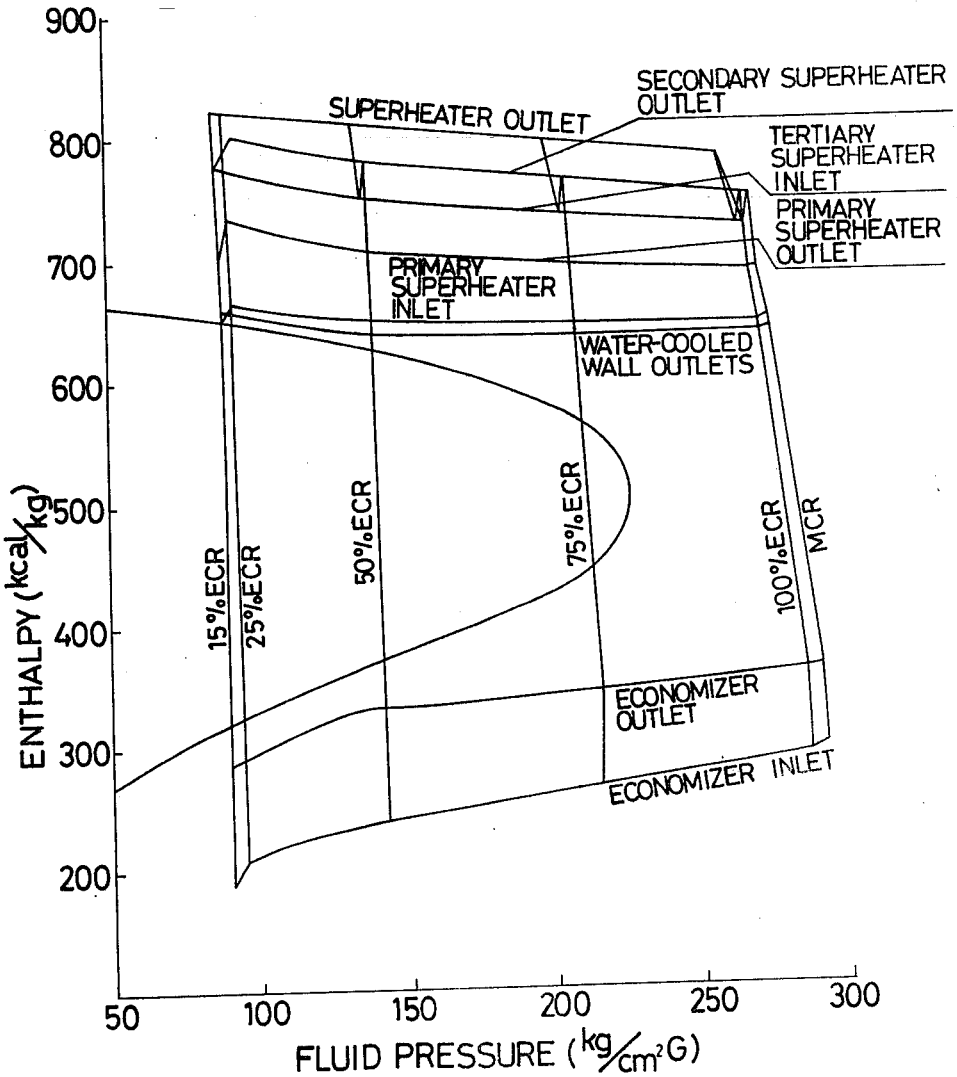
FIG. 4 is a pressure-enthalpy chart of the boiler.
Figure 5:
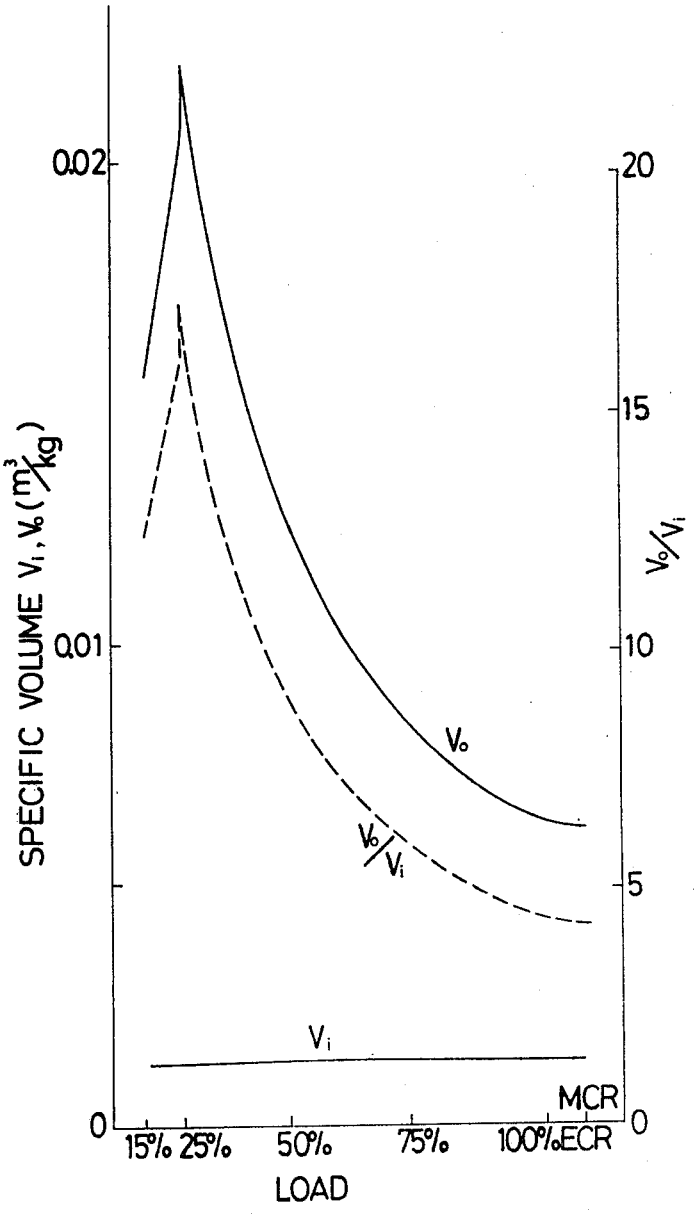
FIG. 5 is a load-specific volume chart of the boiler.
Figure 6:
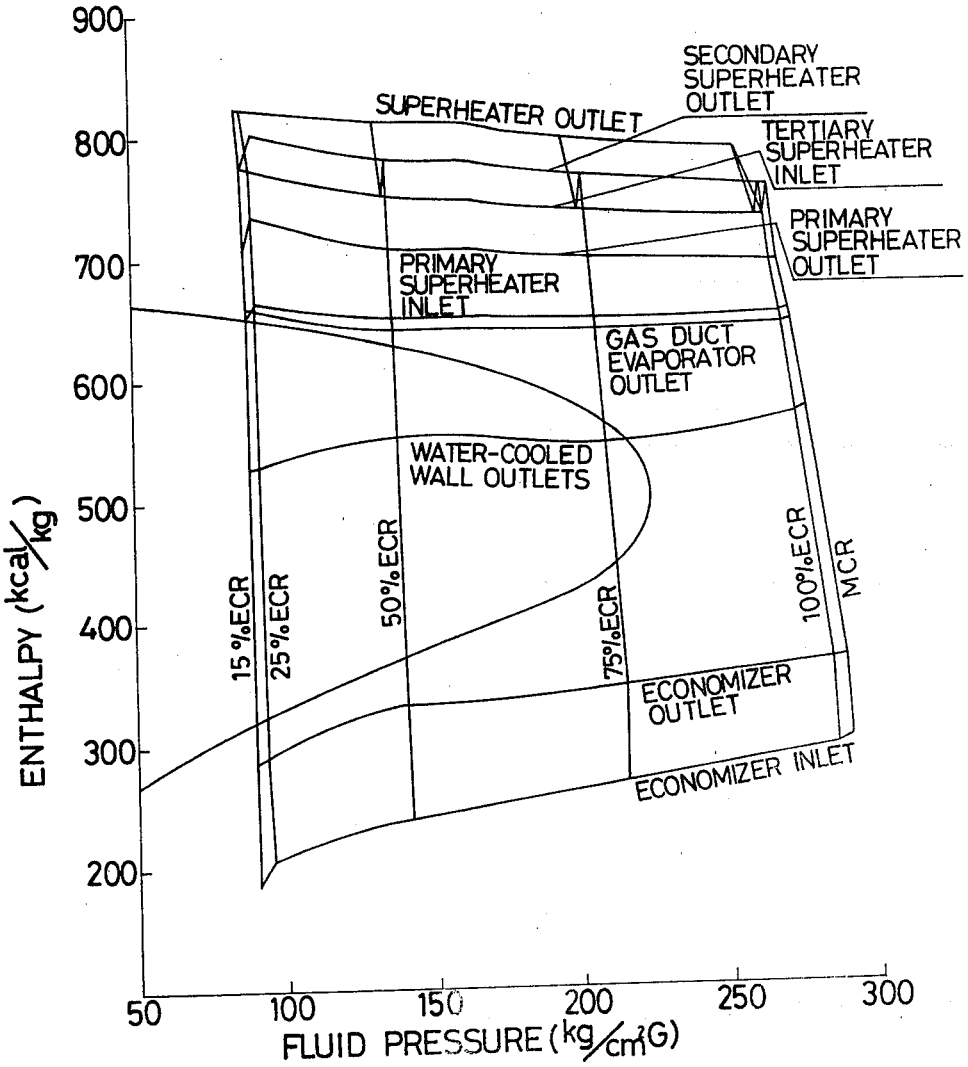
FIG. 6 is a pressure-enthalpy chart of the boiler according to the invention.

In the boiler of the construction above described, as graphically represented in FIG. 6, a wet steam region is maintained in the tubes at the outlets of the water-cooled walls of the furnace composed of the banks of front, rear, and side wall tubes 11, 12, 13, and the steam is heated to a superheated state by the gas duct evaporator 39. Then, even if there is a main flame region formed by corner-firing burners in the furnace of the vertical riser tube type and the generating tubes located in the center and those at the corners of the furnace differ in heat absorption, the presence of wet steam at the water-cooled wall outlets of the furnace will keep the temperature uniform, and no thermal stress will develop in those walls. Moreover, this wet steam will be further heated by the gas duct evaporator 39 so that superheated steam may be supplied to the inlets of the superheaters.

The gas duct evaporator 39 shown in FIG. 7 will be described in more detail with reference to FIGS. 8 through 11. To the lower end of an inlet connecting tube 101 of the gas duct evaporator is attached a distributing manifold 102 of the evaporator, and the manifold 102 and a duct evaporator inlet header 104 are communicated by a plurality of distributing tubes 103. The distributing tubes 103 are connected on the same horizontal level to the manifold 102. The inlet header 104 extends horizontally between the opposed side walls 112 of the gas duct which comprises the opposed side walls 112 formed of side wall tubes, a front wall 111 of front wall tubes, and a rear wall 113 of rear wall tubes. The plurality of distributing tubes 103, equally spaced apart, are connected to the inlet header 104. Pluralities of outflow ports 105*a*, 105*b* are formed on opposite sides of the inlet header 104, symmetrically with respect to the axis of the header and on the same level. To these outflow ports 105*a*, 105*b* are connected, respectively, the inlet tube parts of bifurcated tubes 106*a*, 106*b*, and the bifurcated parts of the tubes 106*a*, 106*b* are connected to evaporator tubes 107 of the gas duct. The evaporator tubes 107 extend between the rear wall 113 and the front wall 111 of the duct and, in the vicinity of these walls, they are bent upward to generally inverted-U contours and are arranged in zigzag fashion. At the top of the arrangement the evaporator tubes 107 extend through the rear wall 113 of the duct and communicate with an outlet header 108 of the duct, to which an evaporator outlet connecting tube 109 is connected. The evaporator tubes 107 are supported by economizer-hanger tubes 110.

Figure 11:
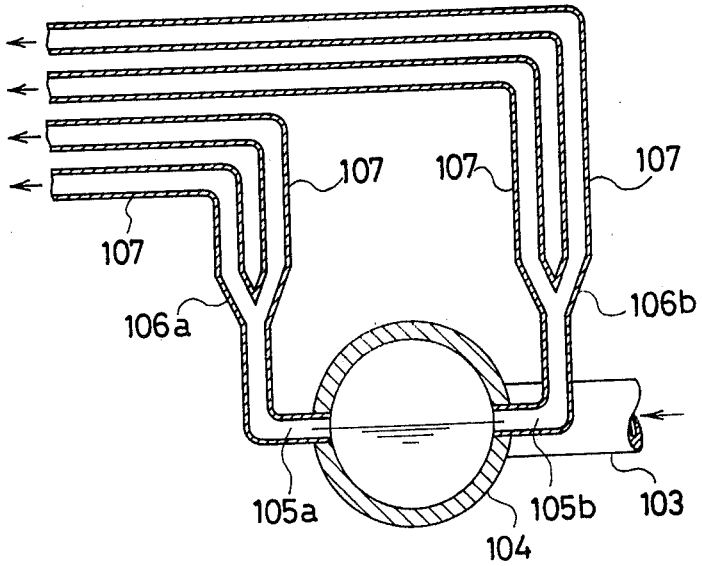
FIG. 11 is a more enlarged view of the onlet header and associated parts of the evaporator.
Figure 9:
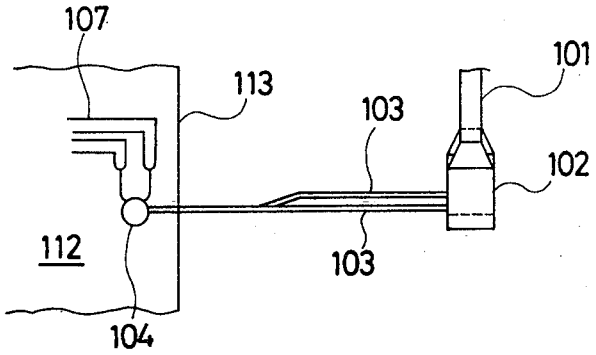
FIG. 9 is a fragmentary detail view in the vicinity of the inlet of the gas duct evaporator.
Figure 10:
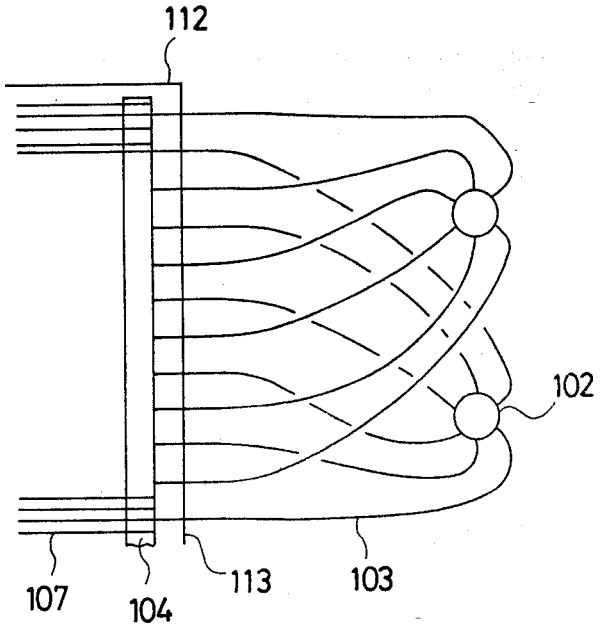
FIG. 10 is a fragmentary plan view of the evaporator.

In the gas duct evaporator of the foregoing construction, a two-phase fluid of steam and water passes through the inlet connecting tube 101 into the manifold 102. Since the plurality of distributing tubes 103 are connected on the same horizontal level to the manifold 102, the two-phase fluid will flow, always at the same steam-water ratio, into the individual distributing tubes, even though steam-water separation may take place in the manifold. Inside the inlet header 104, the two-phase fluid from the distributing tubes 103 undergoes phase separation due to the difference in specific gravity between the vapor and liquid, with the result that the vapor phase occupies the upper space of the inlet header 104 and the liquid phase occupies the lower space. Consequently, an interface is formed inside the inlet header 104. Where the outflow ports 105*a*, 105*b* are formed one each and synmetrically on the opposite sides of the inlet header 104 as shown in FIG. 11, the interface comes just halfway the height or the diameter of the outflow ports 105*a*, 105*b* of the inlet header 104. This is because, if the interface were formed below the ports 105*a*, 105*b*, only the vapor would find its way into those ports and therefore into the bifurcated tubes 106*a*, 106*b*, leaving the liquid behind, and this would naturally result in a rise of the interface. Conversely if the interface were above the outflow ports 105*a*, 105*b*, only the liquid would flow into those bifurcated tubes, this time leaving the vapor behind and lowering the liquid level inside the inlet header 104. In either case, the steam-water interface would settle down to the height shown in FIG. 11 relative to the outflow ports 105*a*, 105*b*.

Thus, there is no possibility of only the vapor or the liquid flowing through the outflow ports 105*a*, 105*b*, but always steam and water flow out in a mixed (two) phase and in substantially equal proportions throughout the banks of outflow ports 105*a*, 105*b*. The bifurcated tubes 106*a*, 106*b* connected to those ports divide the flow from each port into two equal portions. After all, the two-phase fluid of steam and water that entered the inlet header 104 from the distributing tubes 103 is then equally distributed among the evaporator tubes 107. The equally divided portions of the two-phase fluid are heated, as they move through the tubes 107, by the combustion waste gases and are collected at the outlet header 108. The steam and water thus collected are mixed inside the header 108, and the mixture is led through the outlet connecting tube 109 to the water separator.

What is claimed is:

1. A forced-flow once-through boiler for variable supercritical pressure operation comprising burners, water-wall tubes constituting the surrounding walls of a furnace, said water-wall tubes comprising banks of vertical generating tubes for simultaneous upward flow, a water separator, and a convection-heating type evaporator mounted between the outlets of said water-wall tubes and said water separator, wherein said convection-heating type evaporator comprises a manifold connected to an inlet connecting tube, an inlet headed connected to said manifold with a plurality of horizontal distributing tubes, and a plurality of evaporator tubes communicated with said inlet header through bifurcated tubes.

* * * * *